United States Patent [19]

Perez et al.

[11] Patent Number: 4,569,896

[45] Date of Patent: Feb. 11, 1986

[54] RESISTIVE SINGLE COMPONENT DEVELOPER COMPOSITION

[75] Inventors: Steven R. Perez, Pittsford; Jacques C. Bertrand, Ontario; Timothy W. Jacobs, Fairport; Raymond L. Sommers, Webster; George W. Vianco, Jr., Walworth, all of N.Y.

[73] Assignee: Xerox Corporation, Stamford, Conn.

[21] Appl. No.: 659,399

[22] Filed: Oct. 10, 1984

[51] Int. Cl.[4] ..... G03G 9/14

[52] U.S. Cl. ..... 430/106.6; 430/111

[58] Field of Search ..... 430/111, 106.6, 107

[56] References Cited

U.S. PATENT DOCUMENTS

| | | | |
|---|---|---|---|
| 3,965,022 | 6/1976 | Strong et al. | 252/62.1 P |
| 4,189,390 | 2/1980 | Noguchi et al. | 430/111 |
| 4,210,448 | 7/1980 | Forgo | 430/126 |
| 4,286,037 | 8/1981 | Hectors et al. | 430/107 |
| 4,288,519 | 9/1981 | Diamond et al. | 430/137 |
| 4,345,013 | 8/1982 | Diamond et al. | 430/106.6 |
| 4,460,672 | 7/1984 | Gruber et al. | 430/110 |

*Primary Examiner*—John L. Goodrow

*Attorney, Agent, or Firm*—E. O. Palazzo

[57] ABSTRACT

An improved single component magnetic toner composition with a resistivity of from about $10^{13}$ to about $10^{16}$ ohm/cm, at 1,000 volts, and comprised of:

(a) first resin particles of a styrene methacrylate copolymer grafted with or containing a low molecular weight wax composition;

(b) second resin particles of a styrene, acrylate, acrylonitrile terpolymer;

(c) a major amount of magnetite particles; and (d) islands or patches of carbon black particles in an amount of from about 0.1 percent to about 1 percent by weight, contained on the surface of the resin particles.

27 Claims, No Drawings

RESISTIVE SINGLE COMPONENT DEVELOPER COMPOSITION

BACKGROUND OF THE INVENTION

This invention relates to single component developer compositions, and more specifically to single component resistive toner compositions containing magnetic materials therein. In one embodiment, the present invention is directed to magnetic single component resistive toners with islands or patches of carbon black on the surface thereof. These toner compositions are particularly useful in electrostatographic imaging systems wherein an offset preventing liquid, such as a silicone oil is not required.

Developer compositions for use in electrostatographic imaging processes are well known, these compositions generally being comprised of resin particles, pigment particles, and carrier particles. Many of the prior art developer compositions also contain therein various additives, such as fatty acid salts, Aerosil, and other similar materials. There is, for example, described in British Pat. No. 1,442,835 developer compositions with polystyrene resin particles, pigment particles, at least one polyalkylene compound selected from polyethylene and a polypropylene, and as an optional ingredient a paraffin wax and a metal salt of a fatty acid. According to the disclosure of this patent, the addition of a metal salt of a fatty acid provides for the improved compatibility of the polyalkylene compound in the resin component. Also, apparently the dispersion capability of the paraffin wax, pigment particles, and other toner additives, such as charge enhancing additives, is further improved with the use of zinc stearate. For example, it is stated in column 4, beginning at line 45 of this patent that; (1) the non-sticking property of the resulting toner particles are improved; (2) the stability of the toner composition involved can be marketedly enhanced; and (3) the toners life can be sharply prolonged without being subjected to a change in frictional charge characteristics, even when the toner is used for a long period of time. Furthermore, it is indicated in this patent that the resulting toner compositions may also be improved in their moisture resisting properties.

Disclosed in U.S. Pat. No. 3,320,169 is a developer composition comprised of three components, namely magnetic carrier particles, toner particles consisting of a discrete mixture of pigmented resin particles, and an aliphatic acid having from about 10 to 26 carbon atoms, and/or salts of such aliphatic acids. Examples of fatty acids disclosed include saturated or unsaturated acids containing from 10 to 26 carbon atoms such as luric, stearic, oleic, and the like. Preferred additives are calcium stearate and lithium stearate. Examples of thermoplastic resin particles disclosed in this patent include polystyrene resins, acrylic resins, asphalt, polyvinyl resins, and the like.

Further, there is disclosed in numerous prior art patents magnetic toner compositions comprised of a major amount, in excess of 40 percent by weight, of magnetite particles. Thus, for example, there is disclosed in U.S. Pat. No. 3,639,245, a dry toner powder having a specific electric conductivity and containing magnetite particles which are blended with a toner resin, followed by pulverizing the resulting mixture to small particle sizes. Thereafter, the particles are mixed with carbon black and small particle silicone dioxide particles for the purpose of improving flowability. The toner compositions of the '245 patent are conductive, that is, they are of a resistivity of at most $10^{11}$ ohm/cm. There is also disclosed in Xerox copending applications magnetic toner composition comprised of toner resin particles, such as styrene butyl acrylate copolymers, and magnetite particles, in an amount of from about 40 percent by weight to about 70 percent by weight. More specifically, for example, there is disclosed in copending application U.S. Ser. No. 227,003 conductive single component magnetic dry toner compositions comprised of resins selected from polystyrene, allyl alcohol copolymers, and epoxy resins, a magnetic material such as magnetite, and a conductive carbon black which is adhered and/or embedded on the surface of the copolymer or epoxy resin magnetic material mixture. This adherence can be accomplished by a number of known methods, including heat spheroidization. The magnetic particles are present in the developer composition in an amount of from about 40 percent by weight to about 60 percent by weight, and preferably about 50 percent by weight.

Moreover, it is known that in order to substantially eliminate offsetting, and more specifically for the purpose of preventing adhesion of the toner particles to the surface of fixing rollers, there can be selected certain types of rollers the surface of which may be covered with a thin film of an offset preventing liquid, including silicone oils. These oils are highly effective however, the apparatus within which they are incorporated is complicated and costly since, for example, a means for feeding the oil is required. Also, not only do the silicone oils emit an undesirable odor, they have a tendency to deposit on the machine components causing toner particles to collect thereon and adhere to the silicone oils, which is highly undesirable. An accumulation of toner particles on machine components is troublesome in that the image quality is effected, and further these components must be periodically cleaned and/or replaced, adding to the maintenance cost of the machine system involved.

There is a continuing need for improved magnetic toner compositions, particularly those of specific resistivities enabling more effective transfer of the developed image. Moreover, there continues to be a need for single component resistive toner compositions which are useful in electrostatographic imaging devices wherein offset preventing liquids, such as silicone oils are not required. Furthermore there remains a need for improved resistive single component developer compositions which are of sufficient conductivity to enable the development of high solid areas. Also there is a need for single component magnetic toner compositions wherein the resistivity remains stable over relative humidities of from about 40 percent to about 90 percent. Additionally, there continues to be a need for single component resistive toner compositions which are particularly useful in a xerographic imaging process where fusing oils are eliminated.

SUMMARY OF THE INVENTION

It is an object of the present invention to provide toner compositions which overcome some of the above-noted disadvantages.

In a further object of the present invention there are provided resistive single component toner compositions.

In yet another object of the present invention there are provided single component toner compositions containing a major amount of magnetite particles.

In an additional object of the present invention there are provided resistive single component toner compositions which are useful in electrostatographic imaging systems that do not contain silicone oil release fluids.

In yet a further object of the present invention there are provided resistive single component toner compositions that are of sufficient resistivity enabling efficient transfer, while of sufficient conductivity to enable the development of high solid areas.

In a further object of the present invention there are provided methods for developing images with resistive single component toner compositions wherein a silicone oil releasing fluid is not needed for preventing toner offset to the fuser rolls.

In yet a further object of the present invention there are provided single component toner compositions containing additives therein.

In a further object of the present invention there are provided single component toner compositions comprised of islands of carbon black, or similar materials on the surface of the toner resin particles.

These and other objects of the present invention are accomplished by the provision of single component toner compositions containing therein a major amount of magnetite particles. More specifically in accordance with the present invention there are provided single component toner compositions with a resistivity of from about $10^{13}$ to about $10^{16}$ ohm/cm at 1,000 volts, and comprised of:

(1) first toner resin particles of styrene and methacrylate copolymers, or related copolymers grafted with or containing a low molecular weight wax;
(2) second toner resin particles of terpolymers of styrene, acrylate, and acrylonitrile;
(3) magnetite particles in an amount of from about 40 percent by weight to about 70 percent by weight; and
(4) patches or islands of carbon black particles in an amount of from about 0.4 percent by weight to about 1.0 percent by weight contained on the surface of the toner resin particles.

In one preferred embodiment of the present invention there are provided improved single component toner compositions with a resitivity of from about $10^{13}$ to $10^{16}$ ohm/cm, at 1,000 volts, and comprised in combination of:

(1) first toner resin particles consisting essentially of a styrene methacrylate resin copolymer, grafted with or containing a low molecular weight wax selected from polyethylene and polypropylene;
(2) second toner resin particles consisting essentially of a terpolymer of styrene, acrylate, and acrylonitrile;
(3) magnetite particles in an amount of from about 50 percent by weight to about 60 percent by weight;
(4) patches or islands of carbon black particles in an amount of from about 0.75 percent by weight to about 0.9 percent by weight contained on the surface of the toner resin particles, which particles enable the toner composition to retain its resistivity; and
(5) optional additive particles, including colloidal silica substances.

The single component toner compositions of the present invention possess a number of suitable desired properties, including a stable resistivity of from $10^{13}$ to $10^{16}$ ohm/cm, enabling images developed with these compositions to be effectively transferred to paper substrates and allowing the development of high solid areas. Moreover the toner compositions of the present invention are very useful in imaging systems wherein silicone oil release fluids are not required. Also, images obtained with the toner compositions of the present invention are substantially free of undesirable halo affects, and further these images are of high resolution with respect to both lines and solids. The toner compositions of the present invention are also humidity insensitive. Thus, for example, with the toner composition of the present invention comprised, for example, of 55 percent by weight of magnetic particles, and 0.8 percent by weight of patches or islands of carbon black contained on the surface thereof, images with sharp line resolution and excellent solid coverage are generated.

Furthermore, the toner particles of the present invention are of an optimum critical diameter, that is they are from about 5 to about 25 microns in diameter, and preferably most particles are of a medium diameter of 14 microns. In many instances, toner particles with diameters of larger than 25 microns cause degradation of line resolution in the final developed image. Accordingly, a preferred toner composition of the present invention is comprised of 52 to 55 percent by weight of magnetic particles, such as magnetic iron oxides, with from about 0.75 percent by weight to about 0.8 percent by weight of patches or islands of carbon black on the surface thereof, and wherein most of the particles are of an average medium size diameter of about 14 microns.

Illustrative examples of resins that may be grafted with a low molecular weight wax, or contain a wax therein, and thus are useful as the first resin particles for the toner compositions of the present invention include numerous known suitable resins such as polyesters, inclusive of those resulting from the reaction of a dicarboxylic acid and a diol; styrene butadiene copolymers, styrene methacrylates, especially styrene n-butylmethacrylate copolymers, containing from about 65 percent by weight of styrene, and about 35 percent by weight of n-butylmethacrylate, or about 58 percent by weight of styrene, and about 42 percent by weight of n-butylmethacrylate, polyamides, epoxies, polyurethanes, and vinyl resins. Suitable vinyl resins include homopolymers or copolymers of two or more vinyl monomers. Typical examples of vinyl monomeric units include: styrene, p-chlorostyrene vinyl napthalene, vinyl chloride, vinyl bromide, vinyl fluoride, ethylenically unsaturated mono-olefins such as ethylene, propylene, butylene, isobutylene and the like; vinyl esters inclusive of vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methylapha-chloroacrylate, methyl methacrylate, and ethyl methacrylate, butyl methacrylate and the like; vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidenehalides such as vinylidene chloride, vinylidene chlorofluoride and the like; and N-vinyl pyrrolidene and the like; and mixtures thereof. The styrene butylmethacrylate copolymers grafted with, or containing a low molecular weight wax, are commercially available.

Illustrative examples of the second resin particles useful in the present invention as toner resin particles are terpolymer resins, believed to be crosslinked, which resins are commercially available, and are comprised of a terpolymer of styrene, acrylate, such as butylacrylate, and acrylonitrile. In one illustrative embodiment it is believed that the terpolymer resin is comprised of styrene in an amount of from about 55 percent by weight to about 60 percent by weight, butylacrylate in an amount of from about 30 percent by weight to about 35 percent by weight, and acrylonitrile in an amount of from about 5 percent by weight to about 10 percent by weight.

The first and second resin particles are present in the toner composition in an amount of from about 20 percent by weight to about 60 percent by weight, and preferably in an amount of from about 30 percent by weight to about 60 percent by weight. Other amounts of resin particles can be selected providing the objectives of the present invention are achieved.

Illustrative examples of useful magnetic pigments include commercially available materials inclusive of mixtures of iron oxides, providing that the objectives of the present invention are achieved, and that there results a toner with resistivity of from $10^{13}$ to about $10^{16}$ ohm/cm, at about 1,000 volts.

Of critical importance with respect to the single component toner compositions of the present invention is the carbon black contained on the surface of the resin particles. This carbon black is present as islands or patches on the toner resin particles, in an amount of from about 0.1 percent by weight to about 1.0 percent by weight, and preferably in an amount of from about 0.75 percent by weight to about 0.9 percent by weight. The carbon particles are attached to the toner resin particles by causing the resin particles to become tacky, by for example heating, wherein the carbon black particles are affixed thereto. More specifically the carbon black particles are attached to the resin particles by appropriately blending the toner resin particles and carbon black particles with heat, or by heat spheroidization following the carbon black blending thereof for the purpose of perfecting the attachment, and causing the formation of patches or islands of carbon black particles affixed to the surface of the resin particles. Providing the objections of the present invention are achieved, in addition to carbon black other suitable materials can be selected such as tin oxide, zinc oxide and the like.

The carbon black particles are not embedded into the toner resin particles, rather they are contained on the surface thereof enabling a toner of a resistivity of $10^{13}$ to $10^{16}$ ohm/cm, and further allowing effective transfer of the developed toner image to substrates such as plain bond paper. This is contrasted with many prior art toner compositions wherein the carbon black particles are embedded into the toner resin particles and are thus not contained on the surface thereof, or wherein carbon black particles are contained in the interior of the toner resin particles and on the exterior thereof. In Elfotec U.S. Pat. No. 4,210,488, there is disclosed the use of carbon black particles on the interior and exterior of the toner particles however, the disclosure thereof indicates that the carbon black particles on the surface are acting as lubricating materials and are not functioning for the purpose of imparting conductivity properties to the resulting toner particles.

Illustrative examples of useful low molecular weight waxy materials include commercially available polypropylenes and polyethylenes. The commercially available polyethylenes selected have a molecular weight of from about 1,000 to about 1,500, while the commercially available polypropylenes incorporated into the toner compositions of the present invention are believed to have a molecular weight of from about 4,000 to about 5,000. Many of the polyethylene and polypropylene compositions useful in the present invention are illustrated in British Pat. No. 1,442,835. These low molecular weight wax compounds are present in the toner composition of the present invention in various amounts, however, generally these waxes are present in the toner composition in an amount of from about 1 percent by weight to about 10 percent by weight, and preferably in an amount of from about 2 percent by weight to about 5 percent by weight.

The improved resistive toner compositions of the present invention can also contain additive components, for example, silica particles including those comprised of colloidal silica, which are commercially available. Generally the silica particles are present in the toner composition in an amount of from about 0.1 percent by weight to about 1 percent by weight, and preferably in an amount of from about 0.2 percent by weight to about 0.5 percent by weight based on the weight of the toner particles. In one preferred embodiment, the silica particles are present as external additives in an amount of about 0.2 percent by weight.

Also as additives there can be incorporated into the toner composition of the present invention fatty acids or the metal salts thereof. Illustrative examples of fatty acids or fatty acids salts incorporated into the developer composition of the present invention include those as described in U.S. Pat. No. 3,320,169, the disclosure of which is totally incorporated herein by reference. These acids generally contain from about 10 to about 26 carbon atoms, such as lauric acid, palmitic acid, stearic acid, oleic acid, or the calcium, barrium, zinc, nickel stals of these acids. Specific preferred metal fatty acid additives selected are zinc stearate and calcium stearate.

Generally the fatty acid, or the metal salt of the fatty acid is present in an amount of from about 0.1 percent by weight to about 1 percent by weight based on the weight of the toner particles, and preferably in an amount of from about 0.1 percent by weight to about 0.80 percent by weight. In one preferred embodiment of the present invention, the developer composition contains about 0.07 percent by weight of zinc stearate.

The toner compositions of the present invention are useful for causing the development of electrostatic latent images in various imaging apparatuses. In these apparatus the photoconductive imaging member selected includes materials such as inorganic photoreceptor compositions, examples of which are selenium, alloys of selenium, including selenium arsenic, selenium tellurium, selenium tellurium arsenic, and the like, zinc oxide photoreceptor surfaces, and similar equivalent materials. Preferred photoconductive imaging member include zinc oxide, selenium, and a selenium tellurium alloy, comprised of from about 70 to 99 percent by weight of selenium and from about 30 percent to about 1 percent by weight of tellurium. The imaging method involves the formation of an appropriately charge electrostatic latent image on the imaging member, followed by contacting the image with the toner composition of the present invention, followed by transferring the image to a suitable substrate such as paper, and permanently affixing the image thereto by various suitable means including heat. It is important to note that with the imaging method of the present invention wherein roll fusing is selected for permanently affixing the image to a substrate such as paper, a release fluid, such as silicone oil, for preventing toner offset, is not needed, as the toner composition comprised of a mixture of resins, magnetite, and carbon black on the surface thereof, prevents toner offset without a toner release fluid.

The invention will now be described in detail with respect to specific preferred embodiments thereof, it being understood that these examples are intended to be illustrative only and the invention is not intended to be limited to the materials, conditions, process parameters, and the like recited herein. All percentages are by weight unless otherwise indicated.

EXAMPLE I

There was prepared a toner composition by melt blending followed by attrition comprised of 45 percent by weight of resin particles, and 55 percent by weight of magnetite particles, commercially available as magnetic iron oxide. The resin particles consisted of 75 percent by weight of a styrene n-butylmethacrylate copolymer, 65 percent by weight of styrene, 28 percent by weight n-butylmethacrylate copolymer, which consisted of 65 percent by weight of styrene, 28 percent by weight n-butylmethacrylate, and 7 percent by weight of polypropylene wax grafted on the copolymer; and 25 percent by weight of a crosslinked terpolymer containing 63 percent by weight of styrene, 32 percent by weight of butylacrylate, and 5 percent by weight of acrylonitrile. Both of these resins are commercially available. Subsequent to size reduction and classification on an air classifier for the purpose of removing fines, that is those particles with a diameter of less than 3 microns, the toner composition was blended with carbon black without heat and subjected to a heat spheroidization for the purpose of attaching the islands of carbon black on the resin particles. The heat spheroidization was effected in a powder fluidization apparatus, and the temperature of the apparatus was set at 600° F. Thereafter, the resulting toner particles were subjected to further classification for the purpose of removing toner coarse particles of greater than 22 microns. There is then blended onto the surface of the toner particles, the 0.2 percent by weight of the fine silica powder, followed by further classification to remove toner fine particles of less than 5 microns.

The resulting toner composition was comprised of 45 percent by weight of resin particles, 55 percent by weight of magnetite, 0.8 percent by weight of carbon black on the surface of the resin particles, and 0.2 percent by weight of silica powder. Scanning electron micrographs at 50,000 magnification, indicated that the carbon black particles formed islands or patches on the surface of the toner resin particles.

The above-prepared toner composition was then incorporated into a Xerox Corporation imaging test fixture having present therein a zinc oxide photoreceptor, and wherein fixing of the resulting images was affected with a hot roll fuser, no silcon oil releasing agent being present therein. There resulted images of excellent resolution, with both line and solid area sharpness, for 1,500 imaging cycles. This toner composition which was comprised of a substantial number of particles with an average particle diameter of 15 microns, and had a resistivity of $7\times10^{15}$ ohm/cm, at 1,000 volts, provided images with exceptional copy quality stability at all temperature/humidity environments, including 80° C., and 80 percent relative humidity; 75° C. and 55 percent relative humidity; and 60° C. and 20 percent relative humidity.

The resistivity of the toner composition prepared was determined by placing this composition between parallel plates with a diameter of 2.54 centimeters, and a distance therebetween of 0.05 centimeters followed by applying a voltage to the plate and measuring the current.

A toner composition was prepared by repeating the procedure of Example I with the exception that there was selected 1.0 percent by weight of carbon black, enabling 1.0 percent carbon black to be present on the surface of the resin particles as islands or patches. When selected for use in the imaging test fixture of Example I, substantially similar results were obtained.

This toner composition had a resistivity of $6\times10^{14}$ ohm/cm, at 1,000 volts, and average particle size diameter of 15 microns.

EXAMPLE III

Six different toner compositions were prepared by repeating the procedure of Example I with the exception that there was selected in percentages by weight the following amounts of resin particles and magnetite particles:

| | | | | | |
|---|---|---|---|---|---|
| % By Weight of Resin Particles: | | | | | |
| 60 | 55 | 50 | 45 | 40 | 35 |
| % By Weight of Magnetite Particles: | | | | | |
| 40 | 45 | 50 | 55 | 60 | 65 |

Substantially similar results were achieved when these toner compositions were used for developing images in the test fixture of Example I.

EXAMPLE IV

There was prepared a toner composition by repeating the procedure of Example I with the exception that there was selected 55 percent by weight of resin particles, 45 percent by weight of magnetic particles, and wherein the first resin consisted of 54.7 percent by weight of styrene, 39.6 percent by weight of n-butylmethacrylate, and 5.70 percent by weight of polypropylene wax. When this toner composition was used in the imaging text fixture of Example I, substantially similar results were obtained.

This toner had a resistivity of about $1\times10^{14}$ ohm/cm at 1,000 volts.

EXAMPLE V

A toner composition was prepared by repeating the procedure of Example I with the exception that there was selected 0.5 percent by weight of carbon black particles. This toner had a resistivity of $2\times10^{16}$ ohm/cm at 1,000 volts. When this composition was used for the development of images in the xerographic text fixture of Example I substantially similar results were obtained.

EXAMPLE VI

A toner composition was prepared by repeating the procedure of Example I, with the exception that the toner was blended with carbon black with heat. The temperature of the toner particles reached 135° F. during the blending, thus causing the carbon patches to be adhered to the surface of the resin particles without the use of the heat spheroidization step.

Substantially similar results were achieved when these toner compositions were used for developing imaging in the imaging test fixture of Example I.

Although the invention has been described with reference to specific preferred embodiments it is not intended to be limited thereto, rather those skilled in the art will recognize variations and modifications can be made therein which are within the spirit of the invention and within the scope of the following claims.

What is claimed is:

1. An improved single component magnetic toner composition with a resistivity of from about $10^{13}$ to about $16^{16}$ ohm/cm, at 1,000 volts, and consisting essentially of:

(a) first resin particles of a styrene methacrylate copolymer grafted with or containing a low molecular weight wax composition;

(b) second resin particles of a styrene, acrylate, acrylonitrile terpolymer;

(c) a major amount of magnetite particles; and (d) islands or patches of carbon black particles in an amount of from about 0.1 percent to about 1 percent by weight, contained on the surface of the resin particles.

2. An improved composition in accordance with claim 1, wherein the first resin particles are comprised of a styrene, n-butylmethacrylate copolymer.

3. An improved composition in accordance with claim 2, wherein the first resin particles are comprised of a styrene, n-butylmethacrylate resin containing 58 percent by weight of styrene and 42 percent by weight of n-butylmethacrylate, or 65 percent by weight of styrene and 35 percent by weight of n-butylmethacrylate.

4. An improved composition in accordance with claim 1, wherein the second resin particles are comprised of a crosslinked terpolymer resin of styrene, butylacrylate, and acrylonitrile.

5. An improved composition in accordance with claim 1, wherein the magnetite particles are present in an amount of from about 40 percent by weight to about 70 percent by weight.

6. An improved composition in accordance with claim 1, wherein the carbon black particles are situated on the surface of the resin particles by blending and heat spheroidization processing.

7. An improved composition in accordance with claim 1, wherein there is further included in the toner as external additive particles, colloidal silica compositions.

8. An improved composition in accordance with claim 1, wherein the first resin particles contain therein polypropylene wax or polyethylene wax of a molecular weight of from about 1,000 to about 5,000.

9. An improved composition in accordance with claim 8, wherein the polyethylene is of a molecular weight of from about 1,000 to about 1,500, while the polypropylene is of a molecular weight of about 4,000 to about 6,000.

10. An improved composition in accordance with claim 1, wherein the carbon black particles are present in an amount of from 0.75 percent by weight to 0.9 percent by weight.

11. An improved composition in accordance with claim 1, wherein the resin particles are present in an amount of 45 percent by weight, the magnetite particles are present in an amount of 55 percent by weight, and the carbon black particles are present in an amount of 0.8 percent by weight.

12. A method of imaging which comprises generating an electrostatic latent image on an imaging member, followed by developing this image with the toner composition of claim 1, subsequently transfering this image to a suitable substrate, and optionally, permanently affixing the image thereto.

13. A method of imaging in accordance with claim 12, wherein the process is accomplished in the absence of a silicone oil release fluid and there results no offsetting of the resulting images.

14. A method of imaging in accordance with claim 12, wherein the magnetite particles are present in an amount of from about 40 percent by weight to about 70 percent by weight.

15. A method of imaging in accordance with claim 12, wherein the low molecular wax is selected from the group consisting of polyethylene and polypropylene.

16. A method of imaging in accordance with claim 12 wherein the carbon black particles are situated on the surface of the resin particles by blending with heat.

17. A method of imaging in accordance with claim 12 wherein the first resin particles contain therein polypropylene wax or polyethylene wax of the molecular weight of from about 1,000 to about 5,000.

18. A method of imaging in accordance with claim 12 wherein the carbon black particles are present on the surface of the resin particles in an amount of from about 0.75 percent by weight to about 0.9 percent by weight.

19. A method of imaging in accordance with claim 12 wherein the average particle diameter of the toner particles is from about 5 to about 25 microns.

20. An improved composition in accordance with claim 1 wherein the toner particles are of an average particle diameter of from about 5 to about 25 microns.

21. An improved single component magnetic toner composition with a resistivity of from about $10^{13}$ to about $10^{16}$ ohm/cm, at 1,000 volts, which toner can be selected for use in a xerographic imaging apparatus with no offsetting preventing fluid contained therein, and consisting essentially of:

(a) first resin particles of a styrene methacrylate copolymer grafted with or containing a low molecular weight wax composition;

(b) second terpolymer resin particles comprised of styrene, acrylate, and acrylonitrile;

(c) from about 40 percent by weight to about 70 percent by weight of magnetite particles; and (d) islands of patches or carbon black particles in an amount of from about 0.1 percent to about 1 percent by weight present on the surface of the resin particles.

22. An improved composition in accordance with claim 21, wherein the first resin particles are comprised of a styrene and n-butylmethacrylate copolymer with 58 percent by weight of styrene and 42 percent by weight of n-butylmethacrylate, or 65 percent by weight of styrene and 35 percent by weight of n-butylmethacrylate.

23. An improved composition in accordance with claim 21, wherein the second resin particles are comprised of a crosslinked terpolymer of styrene, butylacrylate, and acrylonitrile.

24. An improved composition in accordance with claim 21, wherein the first resin particles contain therein a polypropylene wax or a polyethylene wax of a molecular weight of from about 1,000 to about 5,000.

25. An improved composition in accordance with claim 21, wherein there is further included in the toner composition as external additives compositions selected from the group consisting of colloidal silica, metal salts, and the metal salts of a fatty acid.

26. An improved composition in accordance with claim 25, wherein the metal salt of a fatty acid is zinc stearate.

27. An improved composition in accordance with claim 25, wherein the additives are present in an amount of from about 0.1 percent by weight to about 1 percent by weight.

* * * * *